US010329794B2

(12) United States Patent
Tate

(10) Patent No.: US 10,329,794 B2
(45) Date of Patent: Jun. 25, 2019

(54) WIRE RETAINING FENCE POST

(71) Applicant: FERAL PTY LTD, Queensland (AU)

(72) Inventor: Rodney James Tate, Queensland (AU)

(73) Assignee: FERAL PTY LTD, Queensland (AU)

( * ) Notice: Subject to any disclaimer, the term of this patent is extended or adjusted under 35 U.S.C. 154(b) by 0 days.

(21) Appl. No.: 15/341,690

(22) Filed: Nov. 2, 2016

(65) Prior Publication Data

US 2017/0122000 A1 May 4, 2017

(30) Foreign Application Priority Data

Nov. 2, 2015 (AU) ..... 2015904490

(51) Int. Cl.
*E04H 17/10* (2006.01)
*E04H 17/20* (2006.01)
*E04H 17/24* (2006.01)

(52) U.S. Cl.
CPC ..... *E04H 17/10* (2013.01); *E04H 17/20* (2013.01); *E04H 17/24* (2013.01)

(58) Field of Classification Search
CPC ..... Y10T 16/05; Y10T 24/3742; E04H 17/20; E04H 17/24; E04H 17/02; E04H 17/04; E04H 17/10; E04H 17/12
USPC ..... 256/19, 32, 35, 39, 46, 47, 48, DIG. 5; 16/2.1
See application file for complete search history.

(56) References Cited

U.S. PATENT DOCUMENTS 1,750,257 A * 3/1930 Bonnell ..... H02G 3/0683 16/108
1,760,558 A * 5/1930 Klocke ..... B21D 5/015 16/109
2,188,596 A * 1/1940 Hobert ..... F16B 21/18 16/2.1
3,246,880 A * 4/1966 Weed ..... E04H 17/10 256/57
3,667,645 A * 6/1972 Emmer ..... A47J 31/4407 220/377.1
4,114,859 A * 9/1978 Stenson ..... E04H 17/10 256/48
4,299,363 A * 11/1981 Datschefski ..... H02G 3/083 16/108
4,735,534 A * 4/1988 Oehlke ..... B60Q 1/0683 174/153 G
5,794,990 A * 8/1998 Coppedge ..... E04H 4/06 256/25
2008/0237559 A1* 10/2008 Marchio ..... E06B 11/02 256/32
2012/0211610 A1* 8/2012 Howlett ..... A01G 17/14 248/73
2014/0138596 A1* 5/2014 Ross ..... E04F 11/1859 256/47

(Continued)

*Primary Examiner* — Amber R Anderson
*Assistant Examiner* — Nahid Amiri
(74) *Attorney, Agent, or Firm* — Arc IP Law, PC; Joseph J. Mayo

(57) ABSTRACT

A fence post having an eyelet with wire capture structure to capture a fence wire passing through the fence post and prevent it from escaping once the fence post has been inserted into the ground. Tension is applied to the fence wire during insertion of the fence post into the ground, the wire being restrained from passing through the eyelet once the lock bar has been allowed to fall into a closed position. This then ensures that each length of wire is restrained in place under tension.

11 Claims, 11 Drawing Sheets

(56) References Cited

U.S. PATENT DOCUMENTS

2015/0191882 A1* 7/2015 Sloan ..... E01F 13/12
404/6

* cited by examiner

WIRE RETAINING FENCE POST

CROSS-REFERENCE TO RELATED APPLICATIONS

This application claims priority to Australian Patent Application No. 2015904490, entitled WIRE RETAINING FENCE POST, filed on 2 Nov. 2015, wherein the specification and contents of which is hereby incorporated herein by reference in its entirety.

BACKGROUND OF THE INVENTION

Field of the Invention

Embodiments of the invention generally relate to a fence post and in particular towards fence posts that are designed to secure or grasp fencing wire without the need for manual attachment.

In particular, the fence posts of embodiments of the invention are designed to be driven into the ground by an automatic or semiautomatic process and the wire strung between the fence posts is inserted through the fence posts prior to time of installation into the ground.

Description of the Related Art

The installation of fence posts and fencing wire can be an arduous and time intensive task, especially when the fence to be installed spans sections of several kilometers at any one time. Such a situation is not uncommon in large farms or pastoral holdings where fence lines can extend for tens or hundreds of kilometers.

The manual insertion of fence posts into the ground can take a team of operators many days to complete, each post being driven into the ground separately, aligned and subsequently having the fencing wire material either attached to the fence post or inserted through an appropriate sized aperture or slot within the fence post.

A group of workers may go about the process of setting up a fence by first installing a series of fence posts, for example five individual fence posts, and then after the fence posts have been inserted and fixed into the ground a fencing wire, either a plain wire or barbed wire material, is then attached to the fence post by the use of nails clips or other retaining mechanisms that are known. Alternatively, the fence post may have a notch within which the fencing wire is inserted into a fencing wire retaining element is then attached to the fencing wire and clipped on to the fence. Each retaining member then has to be attached individually, one for each wire element or string attached to the fence post, which may mean anywhere from six to seven attachment points on any single fence post.

Such an approach takes considerable amount of time and also requires at pre-set intervals that the fencing wire be tensioned to ensure that it does not go slack over the span of the fence posts.

Automated or semi-automated post installation machines have now been developed that has substantially automated the driving of fence posts into the ground such that a single operator may now control a post driving machine that can take an individual post from a rack or magazine of posts and at an appropriate predetermined location drive a selected individual post into the ground using, for example, a pneumatic driving means. A single worker can therefore take a stack or magazine of fence posts and cover substantial distances in a single outing saving considerable time and effort.

Such post installation devices may also have pre-strung fencing wire passing through the fence post such that as the fence post is taken from the rack or magazine, fencing wire is already in place through the holes in the fence post.

As the post installation apparatus travels along then this fencing wire is fed out through the machine and posts hammered into place such that the operator is then constructing a complete fence system, consisting of both the fence post and the pre-strung fencing wire through the hole in the fence post, directly into the ground. In this way a completed fence can be prepared with a lot less effort.

For a wire in a fence the longer the span of unrestrained wire, the greater the ability of that wire to accept external loading from, for instance livestock, wildlife or flood waters.

Hence, a fence wire constructed free of longitudinal restraints over, say 100 meters can accept externally applied forces 10 times those that can be applied to a fence wire that has positive restraints at 10 meter centres.

The downside to a fence without positive restraints over hundreds of meters, is that if a wire or multiple wires are broken in one bay (between posts) by, say livestock, wildlife, or falling branches etc., then the entire section of fence will be loosened and become ineffective.

BRIEF SUMMARY OF THE INVENTION

It is an object of embodiments of the invention to overcome, or at least substantially ameliorate, the disadvantages and shortcomings of the prior art.

Other objects and advantages of embodiments of the invention will become apparent from the following description, taking in connection with the accompanying drawings, wherein, by way of illustration and example, embodiments of the invention are disclosed.

According to embodiments of the invention, although this should not be seen as limiting the invention in any way, there is provided a fence post having:

- a main body section having at least one wire receiving aperture there through for receiving a fence wire, and,
- at least one wire capture structure substantially aligned with the at least one wire receiving aperture to capture the fence wire.

In one or more embodiments, the wire capture structure is a wire clamping member.

In one or more embodiments, the fence post includes an elongate channel.

In one or more embodiments, the fence post has a U-shaped cross section.

In one or more embodiments, at least one wire receiving aperture has a wire passing there through.

In one or more embodiments, the wire capture structure includes a locking bar.

In one or more embodiments, the locking bar has an open position and a closed position.

In one or more embodiments, the locking bar can move from the open position to the closed position.

In one or more embodiments, when in the closed position, the locking bar substantially restricts the movement of the wire passing through the wire receiving aperture.

In one or more embodiments, the locking bar urges against the wire passing through the wire receiving aperture.

In one or more embodiments, the locking bar urges against the wire passing through the wire receiving aperture, when in a closed position.

In one or more embodiments, the wire capture structure includes an inner eyelet shaped to nest within the wire receiving aperture.

In one or more embodiments, the inner eyelet includes at least one channel within which to receive the wire locking bar.

In one or more embodiments, the locking bar is substantially U-shaped.

In one or more embodiments, the inner eyelet is held in place within the at least one wire receiving aperture by engagement with and outer eyelet positioned on an outer surface of the fence post.

In one or more embodiments, the wire clamping member is spring activated.

In one or more embodiments, the locking bar is biased towards the closed position.

In one or more embodiments, the locking bar is spring biased towards the closed position so as to capitally hold the fence wire.

Embodiments of the invention address the above problem whilst still providing the higher loading capacity of the fence wire(s). The locking bar is designed to lift and allow wires to pass through in a controlled manner when external loads are applied to the wire(s) (such as livestock, wildlife, or floodwater flow) in a particular bay of fencing.

When the external loads are removed, the tensile stress in the wire(s) diminish, and the locking bar falls back to again lock the wire(s) in place. If a break of wire(s) occurs in a particular bay, the tensile force in that wire is reduced to zero adjacent to the break, and the locking bars in the adjacent posts will drop into the locked position, thus retaining all other bays of fence in a strained, workable condition.

Current practice for steel posts is to tie the fencing wire to each post at generally in the range of 8 meters to 12 meter centres.

For timber posts the thickness of the timber post and the diameter of the hole through which the wire passes combine to provide restraint to prevent wire stripping from breakage in a single bay of fence.

Timber posts, due to their bulk are not suited to high volume, high speed operations of the automated fencing machine.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

Figure 1:
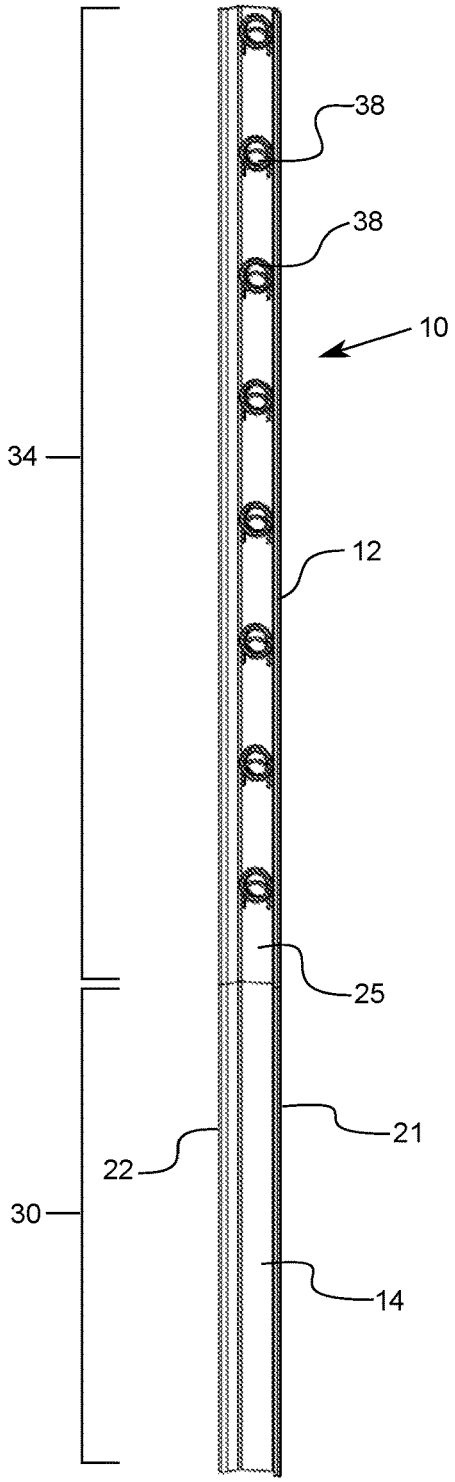
FIG. 1 is a perspective view of one or more embodiments of the invention.
Figure 2:
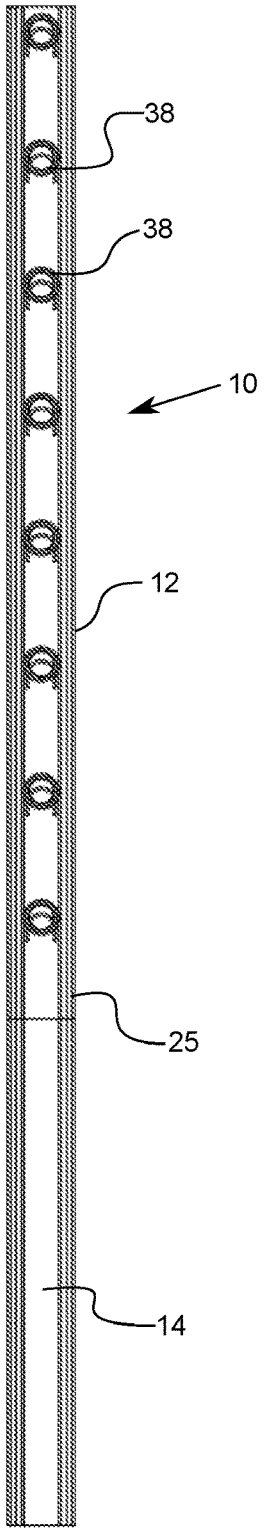
FIG. 2 is a front view of the fence post of FIG. 1.
Figure 3:
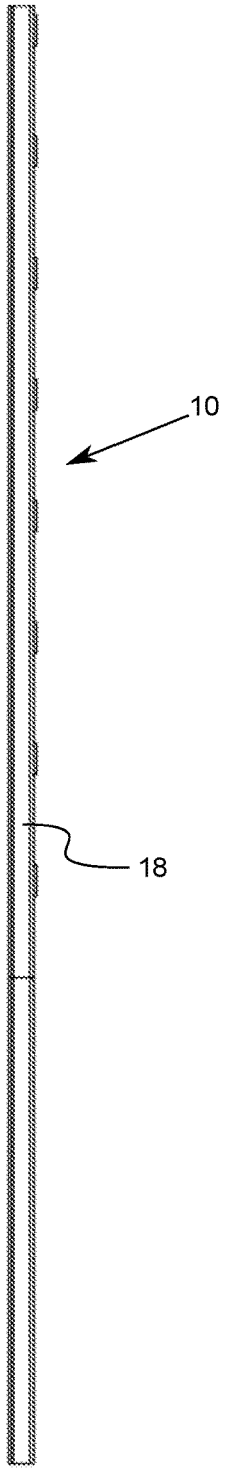
FIG. 3 is a side view of the fence post of one or more embodiments of the invention.
Figure 4:
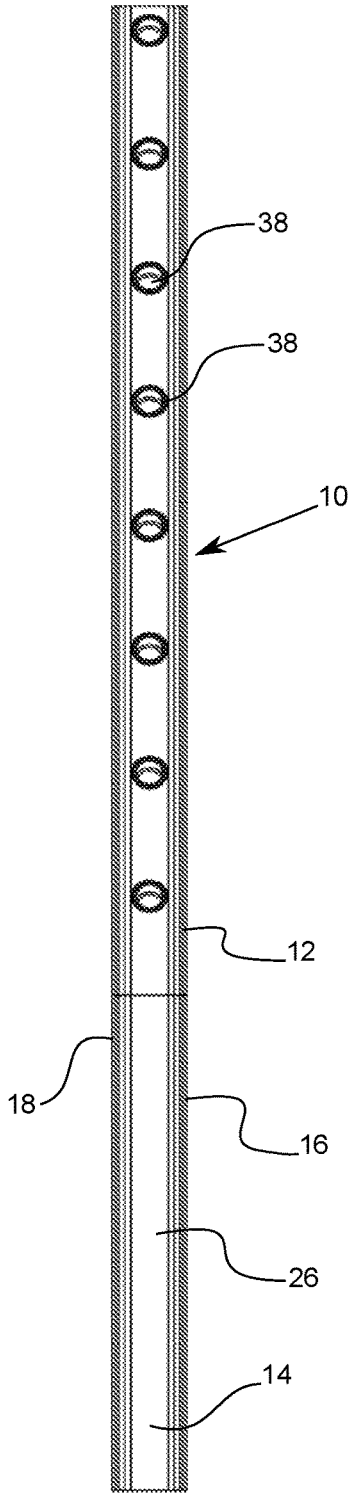
FIG. 4 is a rear view of the fence post of one or more embodiments of the invention.

The fence post 10 of embodiments of the invention has a main body section 12 which is substantially U shaped having a flat section 40 with a front surface 25 and a back surface 26, longitudinal opposing sides 16 and 18 and flanges 20 and 21. The sides 16 and 18 for a channel 24 which defines the U shape. Other shapes of fence posts are considered to fall in the scope of embodiments of the invention, for example flat shaped fence posts.

The fence post 10 has a ground engaging section 30 which is driven into the ground and a wire retaining section 34 upon which there are a number of openings or apertures 38 through which wire can be strung through or received. Each opening 38 has a wire capture mechanism or structure 50.

Figure 5:
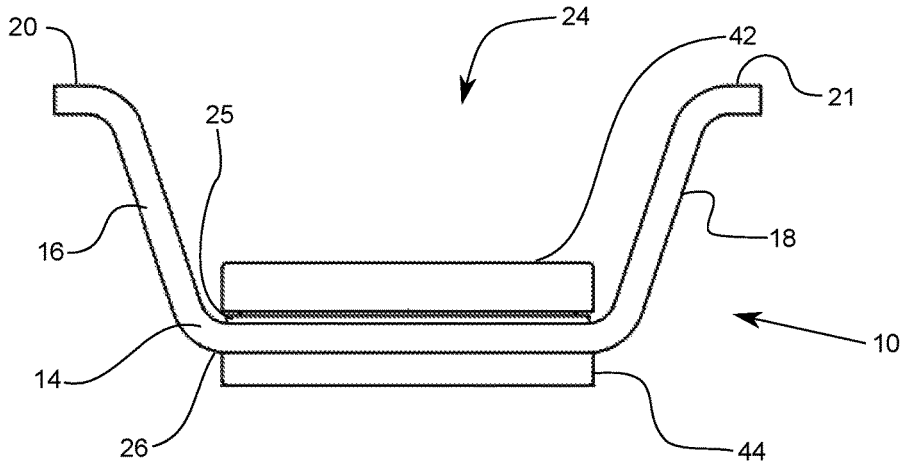
FIG. 5 is a top view of the fence post of FIG. 1.
Figure 6:
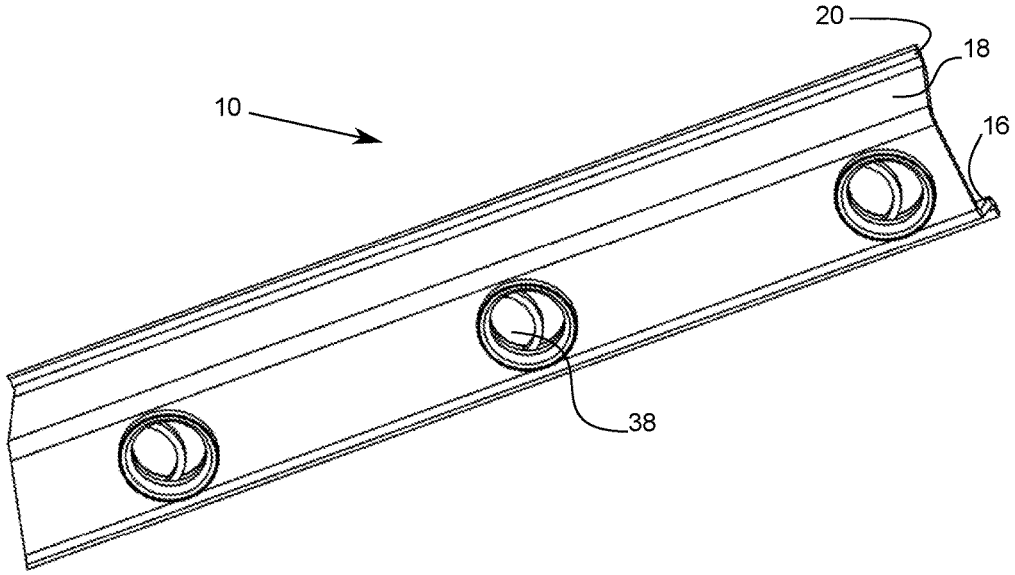
FIG. 6 is a close-up perspective view of a rear section of the shown in FIG. 4.

As shown in the top view of FIG. 5, the wire capture mechanism 50 includes the outer eyelet 42 of the flat section 14 and the rear plate 44 located on the back surface 26 and thus resides substantially in the channel 24.

Figure 7:
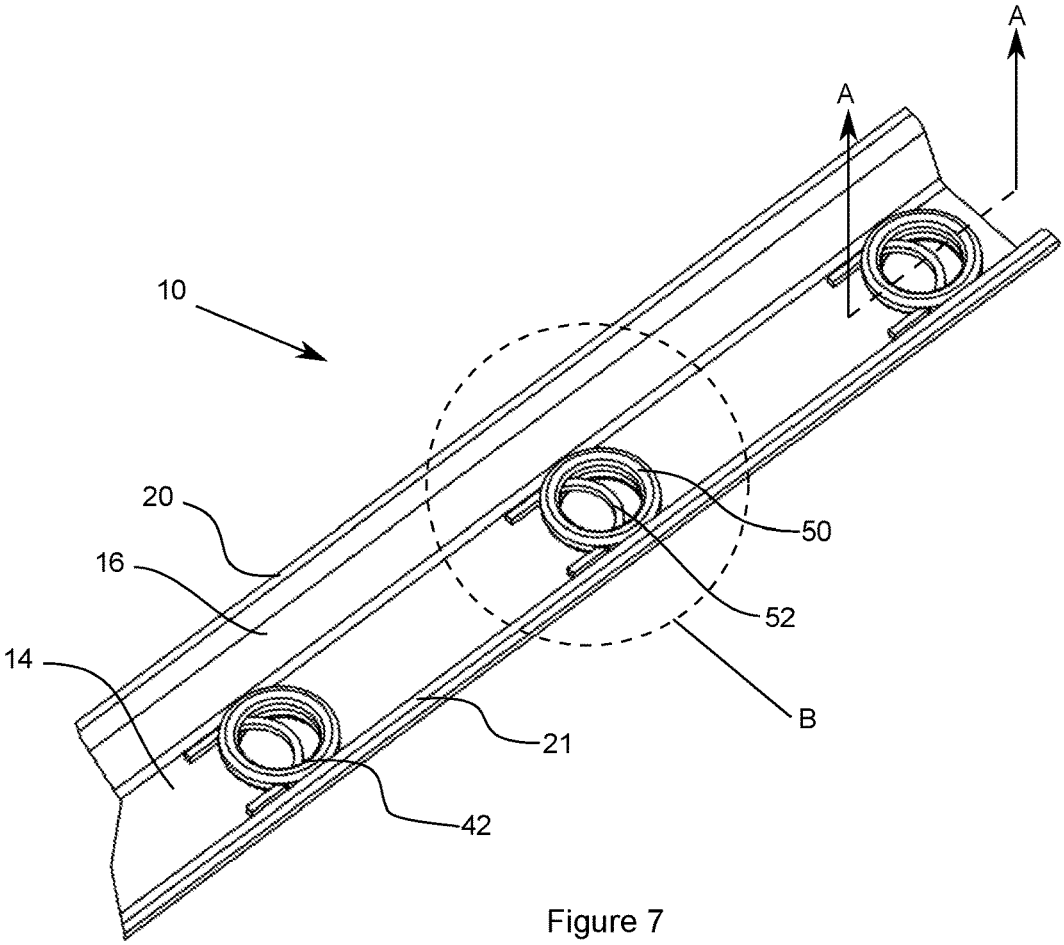
FIG. 7 is a close-up view of a front section of the fence post shown in FIG. 1.
Figure 8:
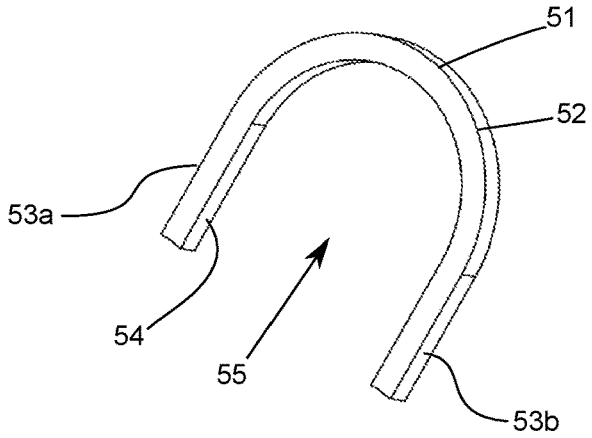
FIG. 8 is a perspective view of a locking bar used in one or more embodiments of the invention.
Figure 9:
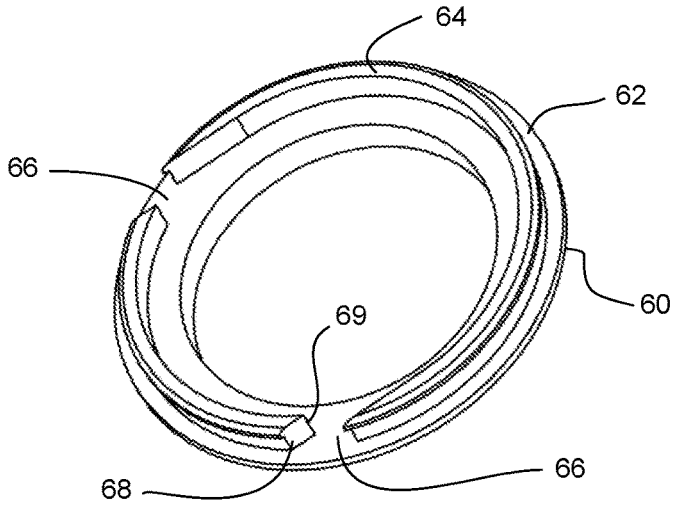
FIG. 9 is a perspective view of an inner eyelet of one or more embodiments of the invention.
Figure 10:
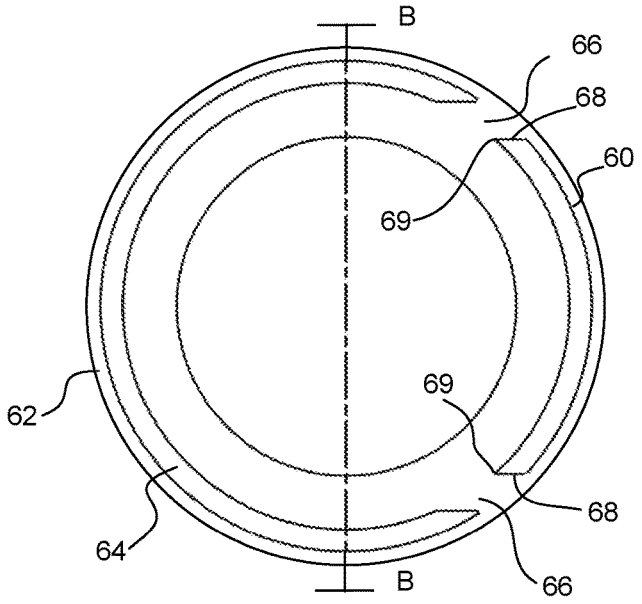
FIG. 10 is a top plan view of the eyelet shown in FIG. 9.
Figure 11:
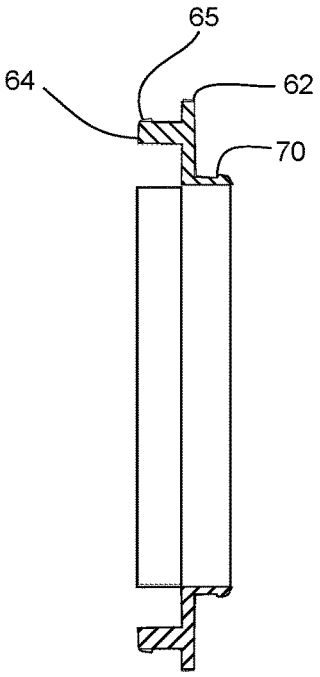
FIG. 11 is a cross sectional view through B-B in FIG. 10.
Figure 12:
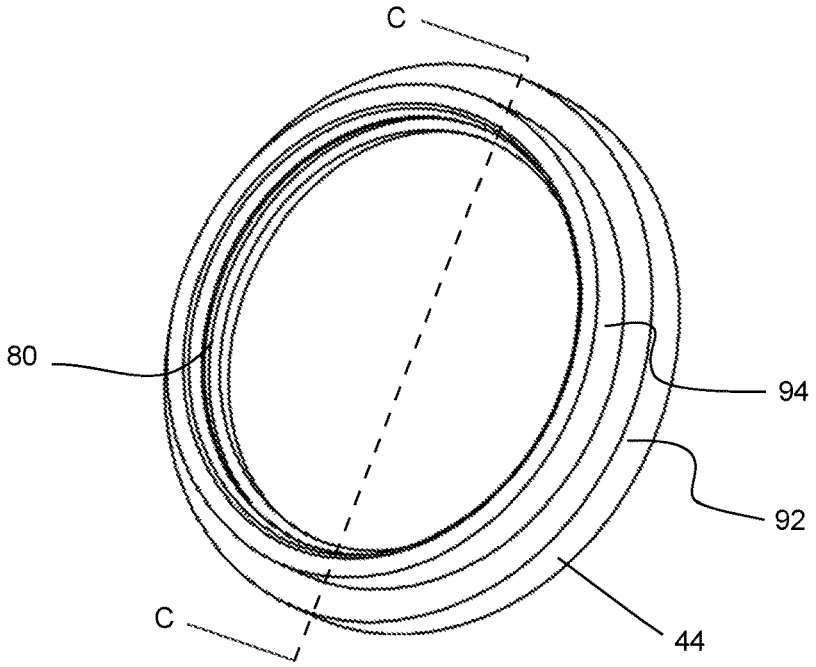
FIG. 12 is a perspective view of the rear plate.
Figure 13:
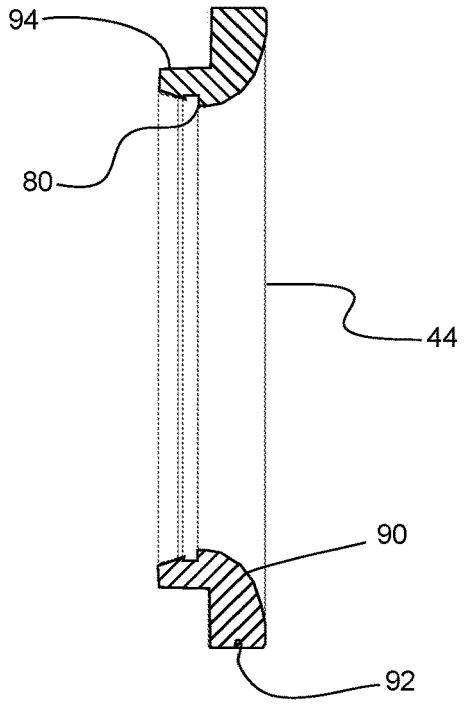
FIG. 13 is a cross-sectional view through C-C of FIG. 12.

With reference to FIG. 7, a close-up perspective view of the front of the fence post 10 is shown, with the wire capture mechanism 50 shown on the front surface 25. The wire capture mechanism 50 includes the outer eyelet 42 and the lock bar 52. The inner eyelet 54 is partially shown in FIG. 7. The lock bar 52 in FIG. 7 is shown in a closed position.

The lock bar 52 is substantially U shaped having straight sections 53*a* and 53*b* joined by the curved section 51. The lock bar may be in the form of other shapes, for example a T shape in which there is only a single straight section and cross section with a flat top section or as a inverted W shape, so long as the locking bar can rest against or exert a force on a wire passing beneath it. The locking bar can be used to block a wire either within the channel 55, as in the present example, or alternatively, if orientated correctly, against the top portion (outer edge) of the curved section 51.

The lock bar 52 fits within the inner eyelet 60 which has periphery flange 62 and the inner outwardly projecting flange 64 that projects substantially perpendicular. Channels 66 are formed in the flange 64 to allow the straight sections 53*a* and 53*b* of the lock bar 52 to pass through. In another example, the inner face 54 of the straight sections 53*a* and 53*b* of the lock bar 52 may have notches thereon to provide a positive engagement with the face 68 of the channel 66 so that the lock bar 52 can only move in one direction or at least resist opening so that it can trap a wire element within. The inner eyelet 60 has the annular projection 70 which nestingly fits within the groove 80 of the rear plate 44 such that they clip together.

The inner plate 44 has a beveled edge 90 and flange 92, the annular projection or rim 94 suitably shaped to fit within the appropriately sized aperture of the fence post 10. The outer eyelet 42 over the flange 64 of the inner eyelet 60 with positive engagement of the notch 65 within an inner groove. This then holds the lock bar 52 in place whilst still allowing it to slide or travel from the open to the closed position.

Figure 14:
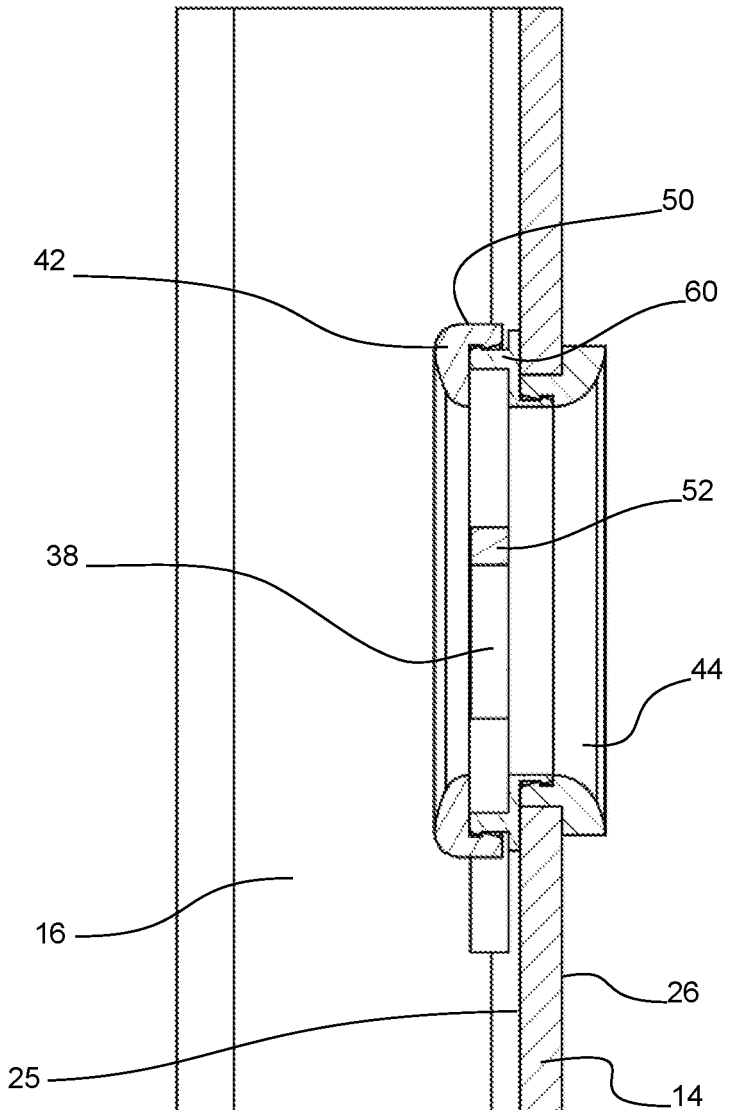
FIG. 14 is a cross sectional view through A-A of FIG. 7.

FIG. 14 shows a cross-sectional view of the wire capture mechanism 50, showing the engagement of the rear plate 44 with the inner eyelet 62 and the outer eyelet 42, the lock bar 52 shown in the closed position.

Figure 15:
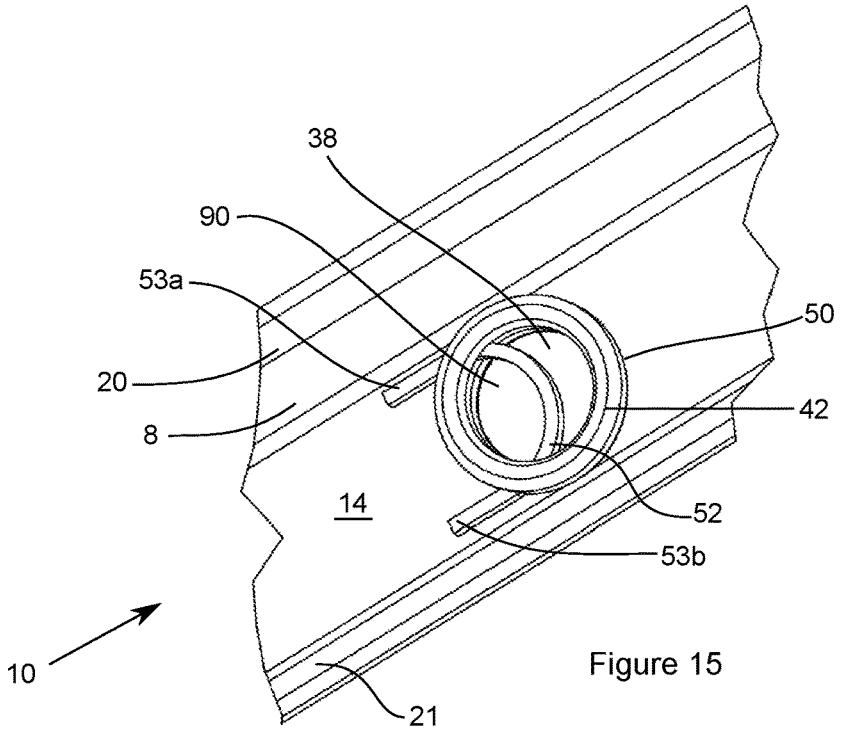
FIG. 15 is an enlarged view of the so-called region a of FIG. 7 showing the locking bar in a partially closed position.

As shown in FIG. 15, with the lock bar 52 in the closed position there is an opening 90 within which a wire (not shown) is trapped or restrained. The lock bar 52 may also be coupled to a biasing means (spring) so as to provide a positive holding force to that which may be in the opening 90 when in the closed position. The lock bar 52 can also function by acting to restrict the passage of a larger diameter section of wire to be held. For example, if the wire to be inserted into the opening is barbed wire then by the action of the lock bar 52 obtaining the closed position then a barb 107 will be prevented from passing through the opening. In this manner then there is no need for the lock bar 52 to have a biasing means.

Figure 16:
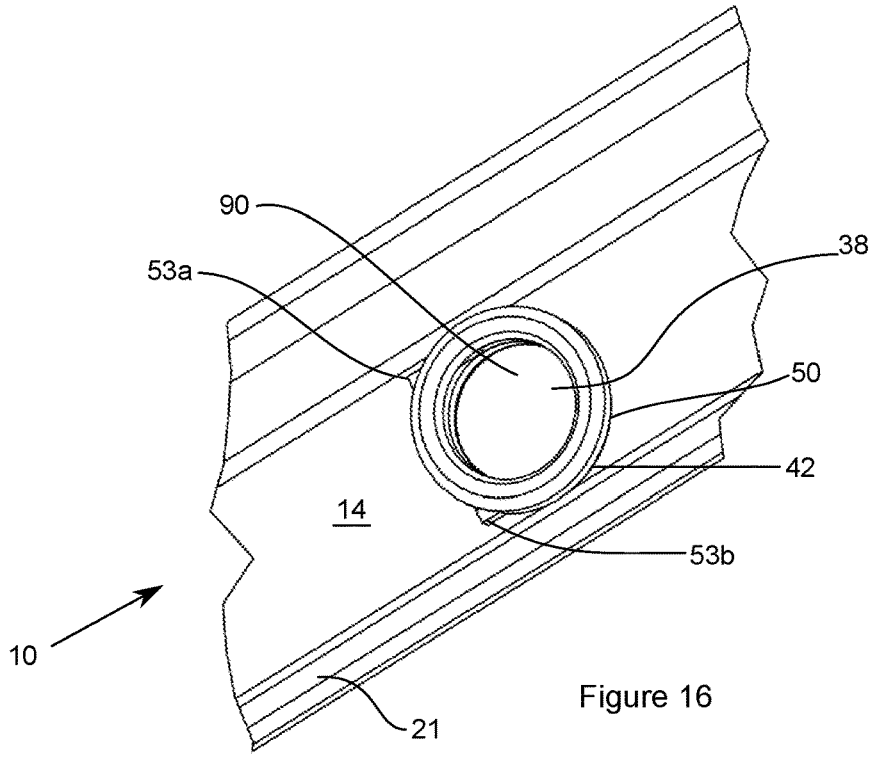
FIG. 16 is the view of FIG. 15 with the locking bar in an open position.
Figure 17:
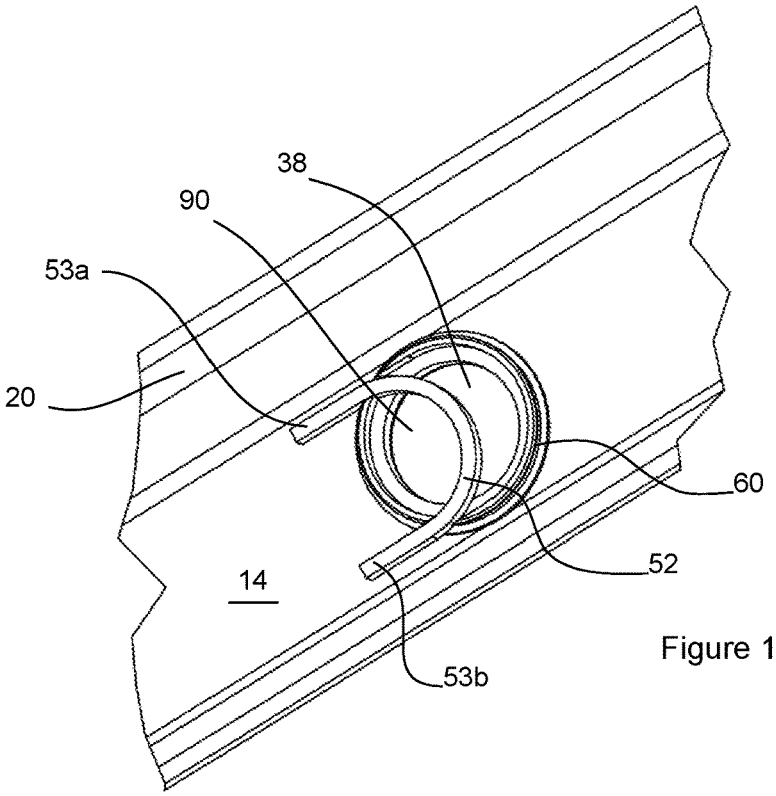
FIG. 17 is the view of FIG. 15 with the outer eyelet removed and the locking bar in the closed position.
Figure 18:
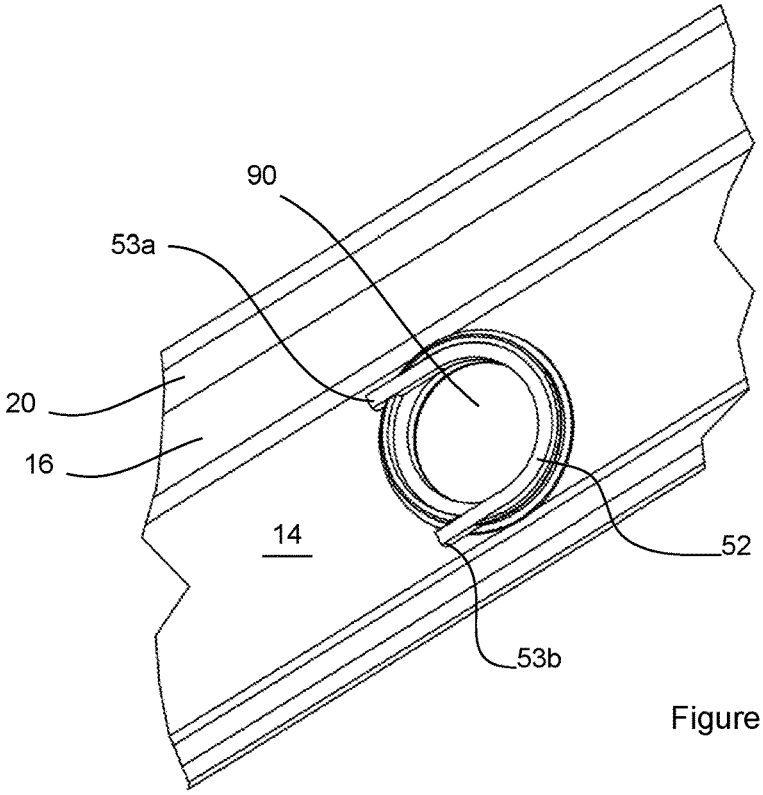
FIG. 18 is the view of FIG. 16 with the outer eyelet removed, showing the locking bar in the open position.

In FIG. 16 the bar lock 52 is in the open position which will allow wire to pass through unrestricted. FIGS. 17 and 18 show the closed and open positions of the lock bar 52 but with the outer eyelet 42 removed for clarity. As can be seen the lock bar 52 can slidably move through the channels 66 of the inner eyelet 60, up to the point where the edge 69 of the face 68 abuts the inner curved face of the lock bar 52.

Figure 19:
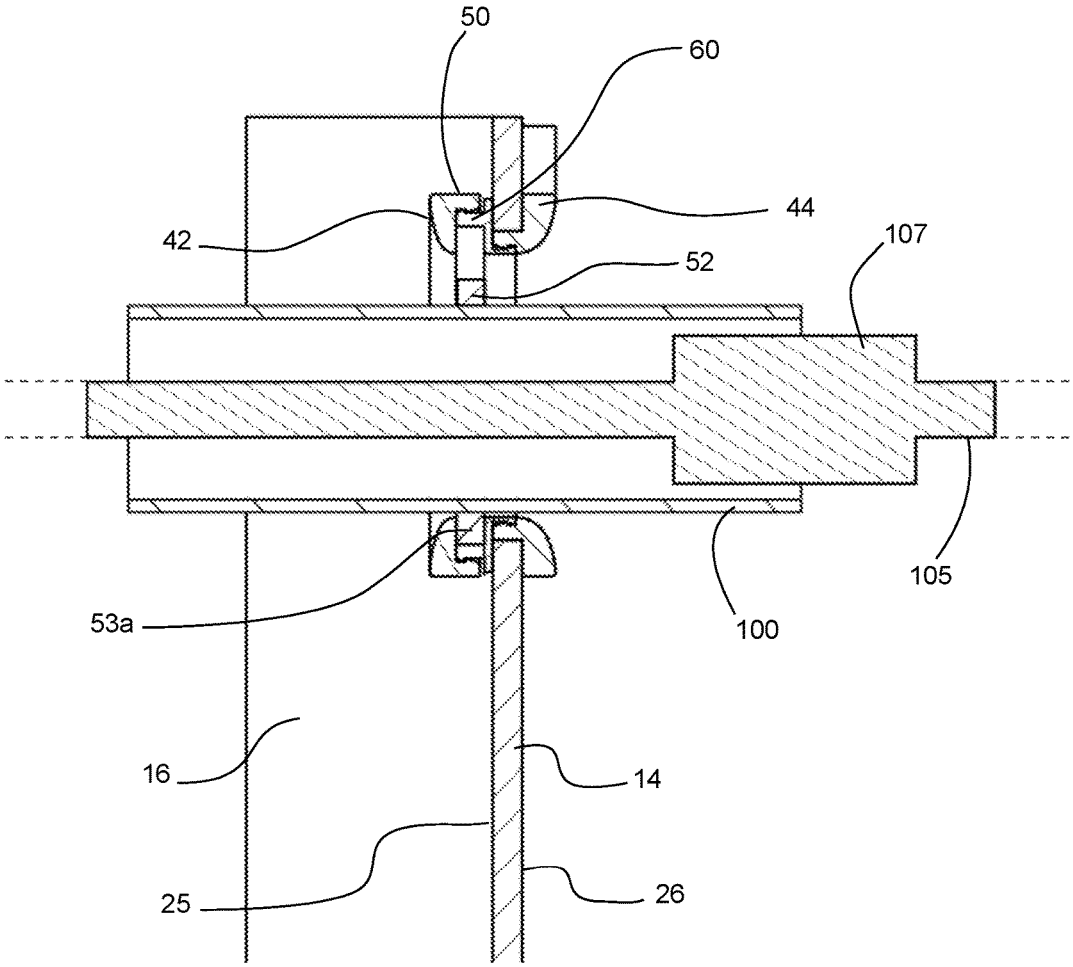
FIG. 19 is a cross sectional view showing the wire capture mechanism in an open position with a wire and a wire guide in place.
Figure 20:
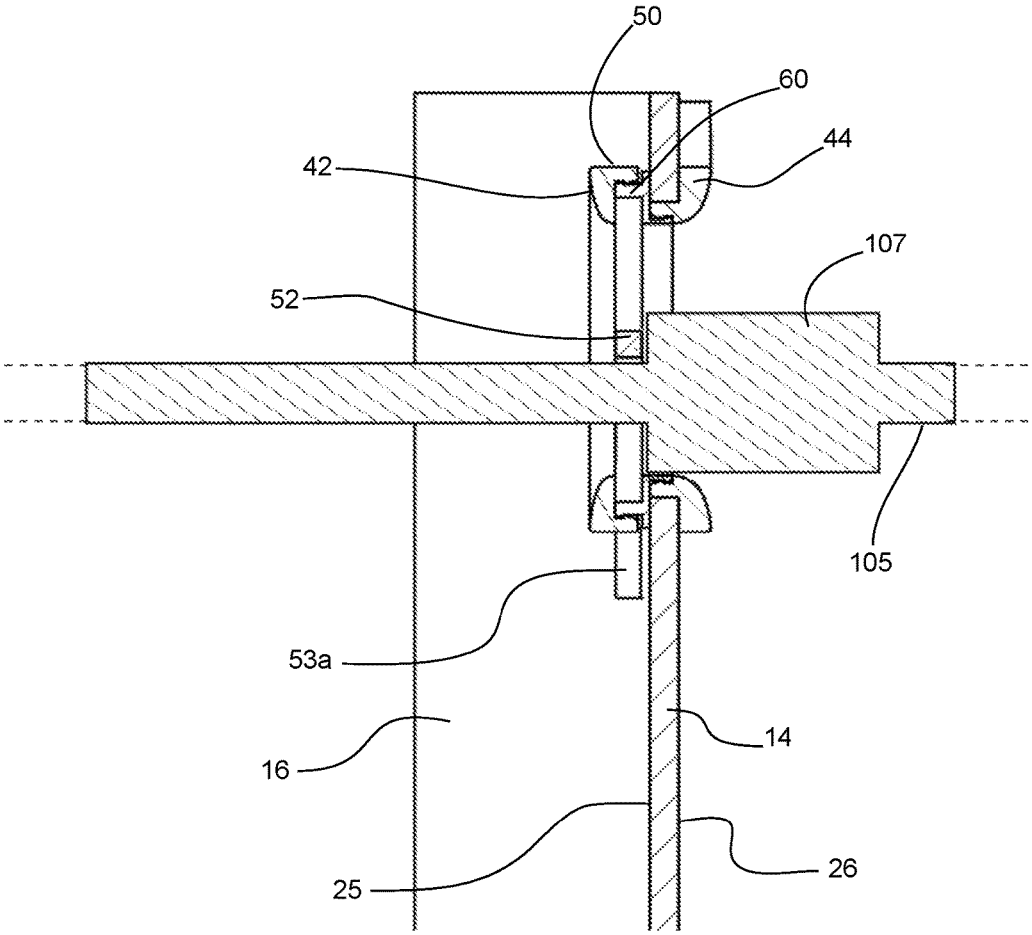
FIG. 20 is the view of FIG. 19 with the wire guide removed and the wire capture mechanism in a closed position.

FIG. 19 shows embodiments of the invention in use in which there is a wire guide 100 passing through the wire capture mechanism 50, the wire guide 100 being substantially tubular and hollow with a fence wire 105 with a barb 107 passing through it. The wire guide 100 prevents the lock bar 52 from engaging with the wire 105. When the wire guide is withdrawn, the lock bar 52 falls into a closed position and prevents the barb 107 from passing through. Alternatively, the lock bar 52 may have a biasing means, such as a spring or similar, that applies a downward force onto the wire sufficient to lock it into place with a clamping effect.

Alternatively, the wire 105 can have two barbs positioned closely together so that when the wire guide is removed the lock bar is allowed to fall between the barbs such that if the wire were to fail or break on either side of the fence post then the wire would be prevented from pulling through the eyelet in an adjacent fence post with a locking mechanism. An adjacent fence post with a locking mechanism may not be immediately adjacent, it may be several regular fence posts away.

As can now be appreciated, embodiments of the invention allow for the rapid and efficient insertion of fence posts fully strung with wire passing through the eyelets of the fence posts which are able to actively hold or prevent the wire string from passing through the eyelet once the post has been taken to be inserted into the ground. Tension is applied automatically by the machine inserting the post, the wire being restrained from passing through the eyelet once the lock bar has been allowed to fall into a closed position. This then ensures that each length of wire is restrained in place under tension. Should a length of wire break during the installation process as the fence post is coming of the fence post installation machine then tension in the remaining wire string will not be lost.

Although at least one embodiment of the invention has been herein shown and described, it is recognized that departures can be made within the scope of the invention, which is not to be limited to the details described herein but it is to be accorded the full scope of the appended claims so as to embrace any and all equivalent devices and apparatus.

What is claimed is:

1. A fence post comprising:

a main body section comprising at least one wire receiving aperture there through, and, at least one wire capture structure, wherein said at least one wire capture structure comprises a sliding wire locking bar, an inner eyelet shaped to nest within said at least one wire receiving aperture, wherein said inner eyelet comprises a pair of channels within which to receive and guide said sliding wire locking bar, and, wherein said at least one wire capture structure is substantially aligned with the at least one wire receiving aperture to capture a fence wire between the sliding wire locking bar and the inner eyelet.

2. The fence post of claim 1, further comprising an elongate channel.

3. The fence post of claim 1, wherein the fence post comprises a U-shaped cross section.

4. The fence post of claim 1, wherein said at least one wire receiving aperture has the fence wire passing there through.

5. The fence post of claim 1, wherein the sliding wire locking bar comprises an open position and a closed position.

6. The fence post of claim 5, wherein the sliding wire locking bar moves from the open position to the closed position.

7. The fence post of claim 6, wherein when in the closed position, the sliding wire locking bar substantially restricts the movement of the fence wire passing through the at least one wire receiving aperture.

8. The fence post of claim 7, wherein the sliding wire locking bar urges against the fence wire passing through the at least one wire receiving aperture.

9. The fence post of claim 8, wherein the sliding wire locking bar urges against the fence wire passing through the at least one wire receiving aperture when in said closed position.

10. The fence post of claim 1, wherein the sliding wire locking bar is substantially U-shaped.

11. The fence post of claim 1, further comprising an outer surface, wherein the inner eyelet is held in place within the at least one wire receiving aperture by engagement with an outer eyelet positioned on said outer surface of the fence post.

* * * * *